US008740193B2

(12) United States Patent
St. Lawrence

(10) Patent No.: US 8,740,193 B2
(45) Date of Patent: Jun. 3, 2014

(54) SYSTEM FOR FORMING MINI MICROBUBBLES

(76) Inventor: Thomas St. Lawrence, Lake Jackson, TX (US)

( * ) Notice: Subject to any disclaimer, the term of this patent is extended or adjusted under 35 U.S.C. 154(b) by 155 days.

(21) Appl. No.: 13/437,507

(22) Filed: Apr. 2, 2012

(65) Prior Publication Data

US 2013/0175712 A1 Jul. 11, 2013

Related U.S. Application Data

(63) Continuation-in-part of application No. 12/466,316, filed on May 14, 2009, now Pat. No. 8,172,206.

(60) Provisional application No. 61/055,716, filed on May 23, 2008.

(51) Int. Cl.
*B01F 3/04* (2006.01)

(52) U.S. Cl.
USPC ..... 261/77; 261/84; 261/93

(58) Field of Classification Search
USPC ..... 261/87, 91, 93, 77, 84; 210/219, 220
See application file for complete search history.

(56) References Cited

U.S. PATENT DOCUMENTS 2,750,328 A * 6/1956 Stimpson et al. ..... 435/295.1
3,279,768 A * 10/1966 Niewiarowicz ..... 261/29
3,387,832 A * 6/1968 Nelson ..... 261/93
3,823,923 A * 7/1974 Chapsal ..... 261/93
3,920,779 A * 11/1975 Abele ..... 261/87
3,984,001 A * 10/1976 Nagano et al. ..... 209/3
4,265,739 A * 5/1981 Dalton ..... 209/169
4,313,898 A * 2/1982 Schurch ..... 261/93
5,194,144 A 3/1993 Blough
5,676,889 A 10/1997 Belgin
6,245,237 B1 6/2001 Blough et al.
6,254,066 B1 7/2001 Drewery
6,394,423 B1 * 5/2002 Vento ..... 261/29
6,461,500 B1 10/2002 Hoage et al.
7,241,615 B2 7/2007 St. Lawrence
7,306,722 B1 12/2007 Hoage
8,172,206 B2 * 5/2012 St. Lawrence ..... 261/93
2002/0109243 A1 * 8/2002 Vento ..... 261/29
2010/0213113 A1 * 8/2010 St. Lawrence ..... 210/219

FOREIGN PATENT DOCUMENTS

GB 2000038 A * 1/1979 ..... 281/87

* cited by examiner

*Primary Examiner* — Robert A Hopkins
(74) *Attorney, Agent, or Firm* — Egbert Law Offices, PLLC

(57) ABSTRACT

A system for forming mini microbubbles has a housing with an upper end and a lower end, a motor positioned in the housing, a shaft connected to the motor, a plate affixed to the shaft and extending radially outwardly therefrom, and an air line connected to the housing so as to open in a space within the housing adjacent the lower end thereof between the plate and the motor. The plate is positioned inwardly of the lower end of the housing. The plate has a smooth lower surface. The motor is a submersible motor.

14 Claims, 2 Drawing Sheets

SYSTEM FOR FORMING MINI MICROBUBBLES

RELATED U.S. APPLICATIONS

The present application is a continuation-in-part of U.S. patent application Ser. No. 12/466,316, now U.S. Pat. No. 8,172,206 filed on May 14, 2009, and entitled, "System for Forming Mini Microbubbles", presently pending. U.S. patent application Ser. No. 12/466,316 claims priority from Provisional Patent Applicant No. 61/055,716, filed on May 23, 2008 and entitled, "System for Forming Mini Microbubbles".

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to systems having optional delivery of multiple and mixed-phase media into liquids using partial vacuum control. Particularly, the present invention relates to systems that form mini microbubbles. More particularly, the present invention relates to aeration systems. Additionally, the present invention relates to enhancing the biological treatment of liquids.

2. Description of Related Art Including Information Disclosed Under 37 CFR 1.97 and 37 CFR 1.98

Mixing, by introducing media, such as a gas or a solid or a liquid or a combination thereof, to a liquid is a common practice when treating liquids such as fresh water, salt water and all types of waste water. As an example, aeration by the introduction of atmospheric air containing oxygen into water is one of the most common methods used to biologically support the aerobic treatment of these liquids. Aerobic treatment of carbonaceous waste requiring an adequate supply of oxygen is much more efficient than anaerobic treatment of carbonaceous waste.

The introduction of various combinations of other gases, liquids, and solids into these liquids is often desirable and beneficial. A variety of biological inoculations and chemical supplements are often used to affect microbial activity and adjust chemical levels. While chlorination is commonly used in fresh water purification, nutrient additions to wastewater microbial cultures are similarly used to regulate and adjust levels of carbon, nitrogen and phosphorous. The chemical oxidation and reduction of compounds in a liquid such as water to accomplish de-nitrification and phosphorous remediation are also common. Desirable biological, chemical and physical activity results in problematic foaming that accumulates on a liquid surface, interferes with normal apparatus operation, and can present a nuisance.

Aerators are used to treat a wide variety of liquids and liquid volumes for a wide variety of applications. Examples of such uses include treating aquariums, septic tanks, ponds, process tanks, municipal treatment plants, lagoons, streams, lakes and oceans.

The use of microbubbles filled with atmospheric air as their media has been used to provide an effective treatment for beneficial aerobic microbial remediation. The liquid under treatment can have conditions requiring mixing, quiescence, or a combination thereof. When larger bubbles are formed, they rapidly rise to the surface of a liquid and gain in volume as the liquid pressure decreases while the bubbles rise. These larger bubbles may be captured at various depths and reprocessed into smaller bubbles. Smaller bubbles remain in liquid for a longer period of time, impart less mixing, and are moved by eddy currents and the Brownian movement of liquids. A mini microbubble is smaller than a microbubble, remains in liquid longer than a microbubble, and imparts a milky appearance to liquids. Mini microbubbles easily flow, rapidly diffuse, and linger within a liquid. Mini microbubbles also have more surface area than larger bubbles. Because gas transfer to liquids is a function of the ratio of surface area to volume, the smaller mini microbubbles have a greater transfer potential and are better for aeration. Thus, there is a need for systems that can create mini microbubbles for the treatment of a liquid.

Creation of a partial vacuum under water can be achieved with displacement of a liquid media. Such measures have been used in prior art to produce a mixture of bubbles of various sizes. Managing the dynamic fluid forces that occur during the mixing, or in particular, during aeration is important in order to produce optimum bubble sizes. Methods using a partial vacuum source to collectively select media from different depths in a liquid at specific points, visibly observe, or hold for sampling, have been used. Methods to dispense media positioned above, in or below the liquid surface are also known and used.

A quantity of gas, such as air, that is released into water under a partial vacuum creates an unstable bubble, termed a "vacuum bubble," which rapidly adjusts its volume until its pressure reaches equilibrium. Thus, a system for precisely controlling the size, quality and quantity of gas bubbles by using the partial-vacuum variables of pressure and volume based on the Gas Law $P1V1=P2V2$ is needed.

Various patents have issued related to aeration systems. For example, U.S. Pat. No. 5,194,144, issued on Mar. 16, 1993 to Blough, discloses an improved aeration device for septic tanks which allows fine bubbles of air to aerate waste material in the tank so that aerobic bacteria may fully perform their decomposing function. Air enters the upper end of a shaft and exists adjacent a propeller. The propeller is protected from interfering with its bubble formation action by a guard bushing concentrically positioned in the air tube so that typical non-organic waste adulterants, such is plastic and rubber materials that are often found in septic tanks, are not drawn into the propeller to interfere with its action.

U.S. Pat. No. 5,676,889, issued on Oct. 14, 1997 to Belgin, discloses an apparatus for aerating and mixing liquids and gases that includes a hollow housing, at least one rotating object, a rotating apparatus for rotating the rotating object, a shaft, and at least one adjustably positioned conduit tube. The hollow housing has a first portion and a second portion. The first portion has a wall that contains at least one port and the second portion has a wall that contains at least one outflow port. The rotating object is located in the second portion and has a low-pressure side. The rotating apparatus rotates the rotating object and is located in the first portion. The shaft connects the rotating object to the rotating apparatus. The adjustably-positioned conduit tube passes through the inflow port and has a first end externally located from the hollow housing. The conduit tube also has a second end located in the low-pressure side so that, upon rotation of the rotating object, a substance can be drawn from the first end to the low-pressure side.

U.S. Pat. No. 6,245,237, issued on Jun. 12, 2001 to Blough et al., discloses an improved method for aeration of septic tanks and the like by drawing atmospheric air into an expansion chamber and, from there, into agitated sludge to provide low-pressure small microbubbles which have long hold times in the sludge material.

U.S. Pat. No. 6,254,066, issued on Jul. 3, 2001 to Drewery, discloses an apparatus for aerating liquid in a wastewater treatment tank having a submergible motor with a shaft extending outwardly therefrom, a supporting member affixed to the submergible motor and adapted to maintain the submergible motor in a position within the liquid in the wastewater treatment tank, a propeller affixed to the shaft of the submergible motor, a housing extending around the propeller and the shaft, and an air tube connected to the housing and adapted to pass air interior of the housing between the propeller and the motor. The housing has a tubular configuration with a diameter slightly greater than the diameter of the propeller. The housing will extending beyond an end of the propeller opposite the shaft. The air tube extends so as to have one end affixed to the housing and communicate with an interior of the housing at an opposite end opening to an area outside of the liquid in the wastewater treatment tank.

U.S. Pat. No. 6,461,500, issued on Oct. 8, 2002 to Hoage et al., discloses an improved method and apparatus for aeration of septic tanks and the like. Because of the interrelationship of the rotating impeller, an air plate, and the horsepower of the unit in comparison with the volumetric size of the sludge tank, the unit disperses extremely small reduced-pressure microbubbles adjacent the area of the impeller. These reduced pressure microbubbles are thereafter dispersed throughout the wastewater by Brownian movement without agitating the sludge. As a result, there is substantially increased lateral oxygen transfer to replace the oxygen used by the aerobic bacteria. The sludge is therefore efficiently digested without the need for huge, expensive and energy-inefficient equipment.

U.S. Pat. No. 7,241,615, issued on Jul. 10, 2007 to St. Lawrence, discloses a wet combustion engine that has a wet combustion chamber within a bioreactor system, an integrated computer control system that, proactively and preemptively, uses feedback from bio-sensors to monitor, record, and control applicable components of the bioreactor system, and a wet combustion diffusion separation-membrane chamber located within a life-support chamber of the bioreactor. In the intake cycle, a suitably prepared fuel mixture is metered into the wet combustion diffusion separation membrane chamber located within the life-support chamber of the bioreactor. In the combustion cycle, diffusion and combustion rates are monitored and timed. In the exhaust cycle, products of combustion, including water and incomplete combustion by-products both organic and inorganic, are removed.

U.S. Pat. No. 7,306,722, issued on Dec. 11, 2007 to Hoage, discloses an improved apparatus and method to increase lateral oxygen transfer in wastewater which eliminates rotating impellers and air plates. As a result, less horsepower per unit can be used to achieve smaller entrained air bubbles resulting in increased residence time and enhanced lateral oxygen transfer to replace oxygen consumed by aerobic bacteria during the biodegradation process. It may be used on industrial waste water sources of all types which are biodegradable by aerobic bacteria.

It is an object of the present invention to mix at least one media with a liquid.

It is another object of the present invention to mix media with a liquid using partial vacuum pressure.

It is another object of the present invention to produce mini microbubbles that are smaller than microbubbles.

It is still another object of the present invention to produce optimal mini microbubbles for any given media and liquid combination.

It is another object of the present invention to create long-lasting mini microbubbles.

It is another object of the present invention to remove odor and solids from waste water.

It is another object of the present invention to chemically treat liquids, such as water.

It is still another object of the present invention to transfer gases, such as dissolved oxygen, in aquaculture.

It is another object of the present invention to deliver, monitor, and control combinations of media, including gases and liquids and solids, with or without mixing.

It is another object of the present invention to use chemical and physical processes that benefit from enhanced dissolution, catalytic combinations, extractions, and remediation.

It is still a further object of the present invention to provide a system for forming mini microbubbles which enhances the quiecense of the treated liquids.

It is still a further object of the present invention to provide a system for forming mini microbubbles that avoids any possibility of clogging.

These and other objects and advantages of the present invention will become apparent from a reading of the attached specification and appended claims.

BRIEF SUMMARY OF THE INVENTION

The present invention is a system for forming mini microbubbles comprises a housing having an upper end and a lower end, a drive means positioned in the housing, a shaft connected to the drive means, a plate affixed to the shaft and extending radially outwardly therefrom, and an air line connected to the housing so as to open in a space within the housing adjacent the lower end thereof between the plate and the drive means. The drive means serves to rotate the shaft. The plate is positioned inwardly of the lower end of the housing.

The housing has an annular wall at the lower end. The plate has an outer periphery adjacent this annular wall.

The drive means is a submersible motor. The housing has a support surface adjacent the lower end. The shaft extends through this support surface. The air line opens to a space between the plate and the support surface.

The plate extends in a horizontal plane inwardly of the lower end of the housing. The lower surface of the plate is smooth. In the preferred embodiment of the present invention, the upper surface is also smooth. However, in an alternative embodiment of the present invention, the upper surface can have ridges formed therein. The plate is in the nature of a disk. This disk has a clamp affixed thereto. The clamp serves to secure the disk to the shaft.

The foregoing Summary of the Invention is intended to describe, in generality, the preferred form of the present invention. It is understood that variations can be made from this preferred form within the concept of the present invention. This section should not be construed, in any way, as limiting of the scope of the present invention. The present invention should only be limited by the following claims and their legal equivalents.

DETAILED DESCRIPTION OF THE INVENTION

Figure 1:
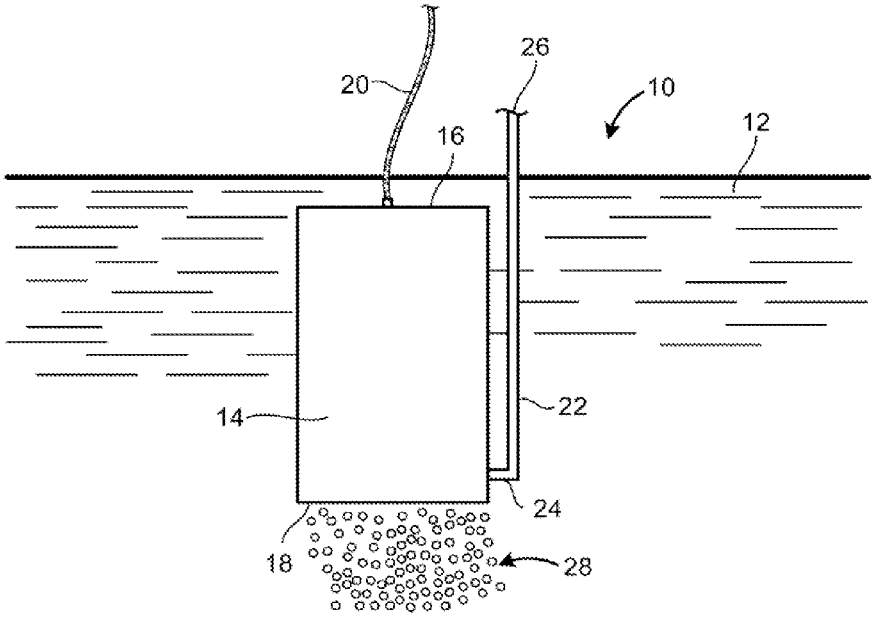
FIG. 1 shows a side cross-sectional view of the system of the present invention as utilized in water.

Referring to FIG. 1, there is shown the system 10 for the forming of mini microbubbles. The system 10 is employed in a body of water 12. Typically, this body of water 12 can be a liquid that is being aerobically treated.

The system 10 of the present invention includes a housing 14 having an upper end 16 and a lower end 18. An electrical line 20 extends to the housing 14 so as to provide power for the drive means located within the housing 14. An air line 22 has one end 24 affixed to the housing 14 generally adjacent the lower end 18 thereof. The air line 22 extends so as to have another end 26 located above the body of water 12 or connected to a source of air.

When the system 10 is operated, mini microbubbles 28 will be released from the lower end 18 of the housing 14, in the manner described hereinafter.

Figure 2:
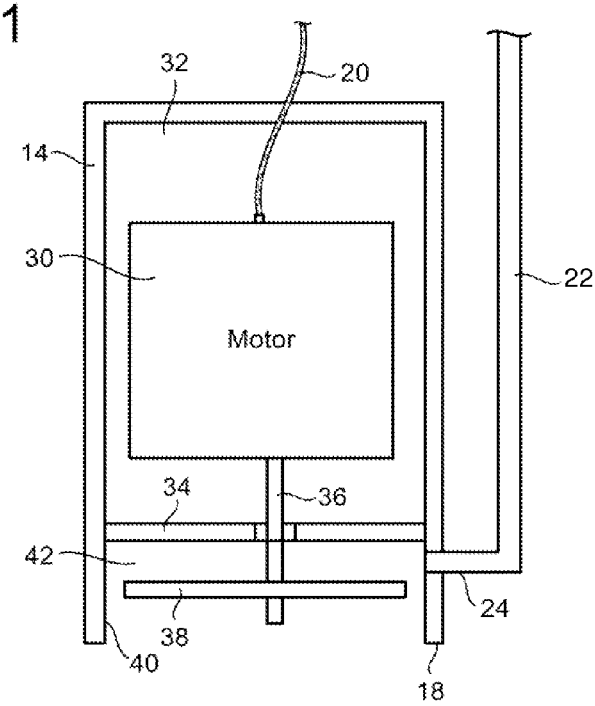
FIG. 2 is a cross-sectional view of the system of the present invention.

In FIG. 2, it can be seen that a motor 30 is received within an interior 32 of housing 14. The motor 30 is in the nature of a submersible motor. The electrical line 20 is connected to the motor 30 and extends outwardly of the housing 14. A support surface 34 is formed across the housing 14 generally adjacent to the lower end 18 thereof. The motor 30 has a shaft 36 extending downwardly therefrom. Shaft 36 extends through bearings formed in the support surface 34 or otherwise through the support surface 34. A plate 38 is affixed to the shaft 36 in a position generally adjacent to the lower end 18 of the housing 14. In particular, the plate 38 extends radially outwardly of the shaft 36. The lower end 18 of the housing 14 has an annular wall 40 formed therein. The periphery of the plate 38 will be adjacent to the annular wall 40. The plate 38 extends in a generally horizontal plane and in a recess inwardly of the lower end 18 of the housing 14.

The air line 22 has the end 24 opening to the space 42 between the upper surface of the plate 38 and the support surface 34. As such, air will enter the space 42 during the rotation of the plate 38.

Figure 3:
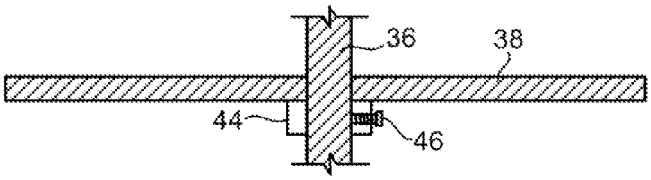
FIG. 3 is a cross-sectional view showing the connection between the plate and the shaft.

FIG. 3 shows how the plate 38 is secured to the shaft 36. In particular, a clamp 44 is affixed to the plate 38. Clamp 44 will extend around the shaft 36. A set screw 46 can be utilized so as to fix the clamp 44 to the exterior surface of the shaft 36. As such, the plate 38 is securely mounted on the shaft 36.

Figure 4:
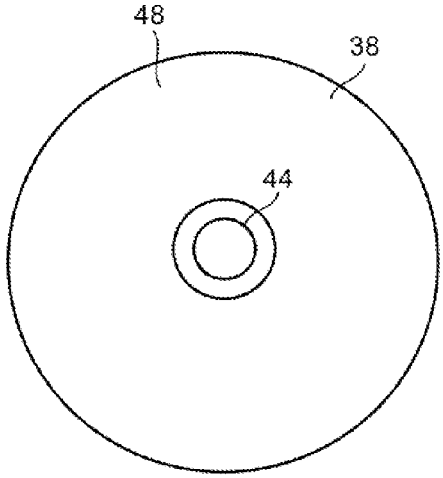
FIG. 4 is a bottom view showing the plate of the present invention.

FIG. 4 shows a bottom view of the plate 38. It can be seen that the plate 38 is a disk having an entirely smooth lower surface 48. The clamp 44 is positioned centrally of the plate 38.

Figure 5:
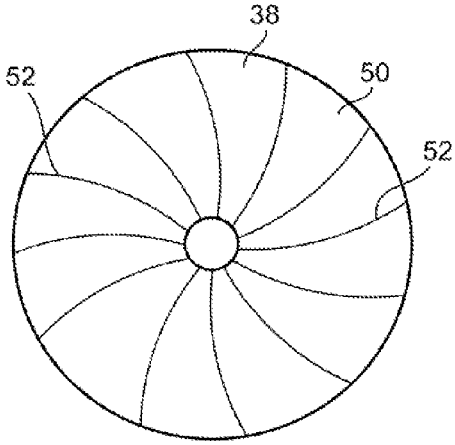
FIG. 5 is a top view showing the plate of an alternative embodiment of the present invention.

FIG. 5 shows an alternative embodiment of the plate 38 and shows, in particular, a different arrangement of the upper surface 50 of plate 38. In FIGS. 3 and 4, the plate 38 has generally smooth upper surface. However, in FIG. 5, it can be seen that there are ridges 52 formed on this upper surface 50 of plate 38. Ridges 52 can be in the nature of vanes that extend upwardly in a generally arcuate fashion. It is believed that it is possible that the use of such ridges 52 enhances the turbulent nature of the air flow passing to the upper surface 50 from the air line 22.

In operation, the smooth plate 38 creates a partial vacuum in the area between the space 42. The rotation of the plate 38 causes water to spin out and slam against the annular wall 40. This creates the requisite turbulence for the formation of the mini microbubbles. Since the surfaces of the plate 38 entirely are smooth, there are no possibility of the accumulation of material in holes, vanes, or other areas formed on the surface of the blades. As such, the mini microbubbles can be produced by the system 10 of the present invention without interruption, maintenance, or repair.

The system 10 of the present invention is novel because the system 10 can be conveniently adjusted for bubble quality (e.g. predominant size) and quantity (e.g. selective gas volume). First, the distance between the support surface 34 and the plate 38 can be adjusted. This distance defines the equalization area where media mixed with the liquid due to the turbulence created by the plate 38. It is in the depth of this area that bubbles form and then are released into the liquid around the periphery of the plate 38 adjacent to the annular wall 40. This seemingly instantaneous collapse, invacination of bubbles to a point of pressure equalization is in direct response to the pressure of the liquid in the equalization area. Invacination is the process in which a gas is introduced into a liquid and specifically refers to the point where the pressure inside a bubble equals the pressure of the liquid surrounding the bubble. The media passing into the equalization area presents a unique opportunity to control ultimate bubble size. The milky appearance of resulting mini microbubbles is an example of such control. The gas between the annular wall 40 and the periphery of the plate 38 is the primary lateral point of release for the liquid entrained with mini microbubbles. Lateral release in this particular area can be useful and desirable for reasons such as added mixing, excluder purging and directional discharging and recovery to and from remote areas.

The depth of deployment to of the system 10 below the surface of the body of water 12 can be adjusted. The position of the housing 14 and the motor 30 can be adjusted vehicle upwardly or vehicle downwardly. It can also be angled in a desired direction. At a given depth, the media flow and partial vacuum can be adjusted to reach a desired bubble size. At any time, by inserting a temporary transparent connection (e.g. clear tubing) a partial pressure can be measured in real time. Using this simple partial pressure observation, and by adjusting the air inflow accordingly, the partial vacuum range can be selected and adjusted until a desired bubble size is generated.

The foregoing disclosure and description of the invention is illustrative and explanatory thereof. Various changes in the details of the illustrated construction can be made within the scope of the claims without departing from the true spirit of the invention. The present invention should be limited only by the following claims and their legal equivalents.

I claim:

1. A system for forming mini microbubbles, the system comprising:

a housing having an upper end and a lower end;

a submersible motor positioned in said housing, said housing having a support surface adjacent to said lower end;

a shaft connected to said submersible motor, said submersible motor for rotating said shaft;

a plate affixed to said shaft and extending radially outwardly therefrom, said plate positioned inwardly of said lower end of said housing, said plate having an upper surface and a lower surface, said lower surface being smooth and uninterrupted; and an air line connected to said housing so as to open in a space within said housing adjacent said lower end thereof between said plate and said submersible motor, said air line opening to a space between said plate and said support surface so as to direct air in a direction toward and transverse to said shaft.

2. The system of claim 1, said housing having an annular wall at said lower end, said plate having an outer periphery adjacent said annular wall.

3. The system of claim 1, said plate extending in a horizontal plane inwardly of said lower end of said housing.

4. The system of claim 1, said upper surface being smooth.

5. The system of claim 1, said upper surface having ridges formed therein.

6. The system of claim 1, said plate being a disk, said disk having a clamp affixed thereto, said clamp securing said disk to said shaft.

7. A system for forming mini microbubbles, the system comprising:

a housing having an upper end and a lower end;

a motor positioned in said housing, said motor having a shaft extending downwardly therefrom;

a single plate affixed to said shaft, said plate having an entirely smooth lower surface; and an air line extending so as to open in a space between said plate and said motor.

8. The system of claim 7, said plate positioned in a recess formed inwardly of said lower end of said housing.

9. The system of claim 8, said recess having an annular wall, said plate having a periphery adjacent said annular wall.

10. The system of claim 7, said motor being a submersible motor, said housing having a support surface adjacent to said lower end, said shaft extending through said support surface, said air line opening to space between said plate and said support surface.

11. The system of claim 7, said plate extending in a horizontal plane inwardly of said lower end of said housing.

12. The system of claim 7, said plate having a ridges formed on an upper surface thereof.

13. The system of claim 7, said plate being a disk, said disk having a clamp affixed thereto, said clamp securing said disk to said shaft.

14. A system for forming mini microbubbles, the system comprising:

a housing having a lower end;

a motor having a shaft extending downwardly therefrom, said shaft extending in said housing toward said lower end thereof;

a single plate affixed to said shaft, said plate positioned in a recess inwardly of said lower end of said housing, said plate having a smooth lower surface; and an air line extending so as to open in a space above an upper surface of said plate, said motor being a submersible motor, said housing having said motor therein, said housing having a support surface adjacent said lower end thereof, said shaft extending through said support surface, said plate positioned adjacent said support surface, said air line affixed to said housing so as to open to a space between said plate and said support surface, said plate extending in a generally horizontal plane, said recess having an annular wall, said plate having a periphery adjacent to said annular wall, said plate being a disk, said disk having a clamp affixed thereto, said clamp securing said disk to said shaft, said disk having an entirely smooth lower surface.

* * * * *